US010506345B2

(12) United States Patent
Klein et al.

(10) Patent No.: US 10,506,345 B2
(45) Date of Patent: Dec. 10, 2019

(54) SYSTEM AND METHOD FOR A MICROPHONE

(71) Applicant: Infineon Technologies AG, Neubiberg (DE)

(72) Inventors: Wolfgang Klein, Zorneding (DE); Reinhard Gabl, Kufstein (AT)

(73) Assignee: INFINEON TECHNOLOGIES AG, Neubiberg (DE)

( * ) Notice: Subject to any disclaimer, the term of this patent is extended or adjusted under 35 U.S.C. 154(b) by 0 days.

(21) Appl. No.: 15/643,842

(22) Filed: Jul. 7, 2017

(65) Prior Publication Data

US 2017/0311082 A1 Oct. 26, 2017

Related U.S. Application Data

(62) Division of application No. 14/298,529, filed on Jun. 6, 2014, now Pat. No. 9,736,590.

(51) Int. Cl.

| | |
|---|---|
| ***H04R 7/02*** | (2006.01) |
| ***H04R 23/00*** | (2006.01) |
| ***H04R 19/00*** | (2006.01) |

(52) U.S. Cl.

CPC ..... *H04R 7/02* (2013.01); *H04R 19/005* (2013.01); *H04R 23/00* (2013.01); *H04R 2201/003* (2013.01)

(58) Field of Classification Search

CPC ..... H04R 7/02; H04R 19/005; H04R 23/00
USPC ..... 257/416–419
See application file for complete search history.

(56) References Cited

U.S. PATENT DOCUMENTS

| | | | |
|---|---|---|---|
| 7,912,236 | B2 | 3/2011 | Dehe et al. |
| 8,461,655 | B2 | 6/2013 | Klein et al. |
| 9,219,963 | B2 | 12/2015 | Yang et al. |
| 2008/0247573 | A1 | 10/2008 | Pedersen |
| 2012/0091544 | A1 | 4/2012 | Reichenbach et al. |
| 2012/0248551 | A1 | 10/2012 | Baars et al. |
| 2012/0248554 | A1 | 10/2012 | Klein et al. |
| 2012/0319217 | A1 | 12/2012 | Dehe et al. |
| 2013/0065343 | A1 | 3/2013 | Yang et al. |
| 2013/0105921 | A1 | 5/2013 | Najafi et al. |
| 2014/0072152 | A1 | 3/2014 | Yang et al. |
| 2014/0270271 | A1 | 9/2014 | Dehe et al. |
| 2015/0076627 | A1 | 3/2015 | Johansen et al. |
| 2015/0358735 | A1 | 12/2015 | Klein et al. |
| 2016/0090303 | A1* | 3/2016 | Zinn ..... B81C 1/00246 438/53 |

FOREIGN PATENT DOCUMENTS

| | | | |
|---|---|---|---|
| CN | 102740200 | A | 10/2012 |
| CN | 102792715 | A | 11/2012 |
| DE | 112011105845 | T5 | 7/2014 |
| DE | 102014204712 | A1 | 9/2014 |
| JP | 2014090514 | A | 5/2014 |
| KR | 20120112208 | A | 10/2012 |
| WO | 2011012360 | A1 | 2/2011 |

* cited by examiner

*Primary Examiner* — Ori Nadav
*Assistant Examiner* — Vernon P Webb
(74) *Attorney, Agent, or Firm* — Slater Matsil, LLP

(57) ABSTRACT

According to an embodiment, a microfabricated structure includes a cavity disposed in a substrate, a first clamping layer overlying the substrate, a deflectable membrane overlying the first clamping layer, and a second clamping layer overlying the deflectable membrane. A portion of the second clamping layer overlaps the cavity.

20 Claims, 8 Drawing Sheets

SYSTEM AND METHOD FOR A MICROPHONE

CROSS-REFERENCE TO RELATED APPLICATIONS

This application is a divisional of U.S. application Ser. No. 14/298,529 filed on Jun. 6, 2014, which application is hereby incorporated herein by reference.

TECHNICAL FIELD

The present invention relates generally to microfabricated structures, and, in particular embodiments, to a system and method for a microphone.

BACKGROUND

Transducers convert signals from one domain to another and are often used in sensors. One common sensor with a transducer that is seen in everyday life is a microphone that converts sound waves to electrical signals.

Microelectromechanical system (MEMS) based sensors include a family of transducers produced using micromachining techniques. MEMS, such as a MEMS microphone, gather information from the environment by measuring the change of physical state in the transducer and transferring the signal to be processed by the electronics which are connected to the MEMS sensor. MEMS devices may be manufactured using micromachining fabrication techniques similar to those used for integrated circuits.

MEMS devices may be designed to function as oscillators, resonators, accelerometers, gyroscopes, pressure sensors, microphones, micro-mirrors, etc. Many MEMS devices use capacitive sensing techniques for transducing the physical phenomenon into electrical signals. In such applications, the capacitance change in the sensor is converted to a voltage signal using interface circuits.

For example, a capacitive MEMS microphone includes a backplate electrode and a membrane arranged in parallel with the backplate electrode. The backplate electrode and the membrane form a parallel plate capacitor. The backplate electrode and the membrane are supported by a support structure arranged on a substrate.

The capacitive MEMS microphone is able to transduce sound pressure waves, for example speech, at the membrane arranged in parallel with the backplate electrode. The backplate electrode is perforated such that sound pressure waves pass through the backplate while causing the membrane to vibrate due to a pressure difference formed across the membrane. Hence, the air gap between the membrane and the backplate electrode varies with vibrations of the membrane. The variation of the membrane in relation to the backplate electrode causes variation in the capacitance between the membrane and the backplate electrode. This variation in the capacitance is transformed into an output signal responsive to the movement of the membrane and forms a transduced signal.

One characteristic of a MEMS device is the robustness of the MEMS device. For example, a capacitive MEMS microphone has a characteristic robustness which determines the magnitude of shock or impact the MEMS microphone can withstand without damage. Often, the membrane, which is deflectable, is more prone to fracture or failure from shock or impact than other portions of the MEMS microphone.

SUMMARY

According to an embodiment, a microfabricated structure includes a cavity disposed in a substrate, a first clamping layer overlying the substrate, a deflectable membrane overlying the first clamping layer, and a second clamping layer overlying the deflectable membrane. A portion of the second clamping layer overlaps the cavity. In an embodiment, a method of fabricating a microfabricated device includes forming a first backplate including a first region with outermost perimeter perforations surrounding a first planar area, forming a first clamping layer adjacent to the first backplate, the first clamping layer including a first cavity with a second planar area larger than the first planar area, the second planar area extending across the first cavity and being enclosed by a sidewall of the first clamping layer that faces the first cavity, forming a second backplate including a second region with outermost perimeter perforations surrounding a third planar area that is larger than the first planar area, forming a second clamping layer adjacent to the second backplate, the second clamping layer including a second cavity with a fourth planar area larger than the second planar area, the fourth planar area extending across the second cavity and being enclosed by a sidewall of the second clamping layer that faces the second cavity, forming a membrane layer between the first clamping layer and the second clamping layer, and forming a substrate including a third cavity, wherein the third cavity has a fifth planar area larger than the fourth planar area, the fifth planar area extending across the third cavity and being enclosed by a sidewall of the substrate that faces the third cavity. In an embodiment, forming the third cavity includes etching through the substrate from a backside of the substrate to a front-side of the substrate. In an embodiment, forming the first clamping layer includes depositing an insulating layer on the substrate, and etching the insulating layer in and around the perimeter perforations in the first region. In an embodiment, forming the substrate includes separating the third cavity from the first cavity by the first backplate. In an embodiment, forming the substrate includes separating the third cavity is separated from the second cavity by the second backplate. In an embodiment, the second cavity is acoustically coupled to a sound port. In an embodiment, forming the first backplate includes forming central perforations surrounded by the outermost perimeter perforations, and wherein the central perforations have a larger diameter than the outermost perimeter perforations. In an embodiment, forming the first backplate further includes forming intermediate perforations, and the intermediate perforations surround the central perforations and are surrounded by the outermost perimeter perforations, and the intermediate perforations have a larger diameter than the outermost perimeter perforations and a smaller diameter than the central perforations. In an embodiment, the outermost perimeter perforations have a diameter less than or equal to 1.5 μm. In an embodiment, forming the second backplate includes forming central perforations surrounded by the outermost perimeter perforations, and the central perforations have a larger diameter than the outermost perimeter perforations. In an embodiment, forming the second backplate further includes forming intermediate perforations, and the intermediate perforations surround the central perforations and are surrounded by the outermost perimeter perforations, and the intermediate perforations have a larger diameter than the outermost perimeter perforations and a smaller diameter than the central perforations. In an embodiment, the outermost perimeter perforations surrounding the first planar area completely surround the first planar area and are evenly spaced, and the outermost perimeter perforations surrounding a third planar area completely surround the third planar area and are evenly spaced.

BRIEF DESCRIPTION OF THE DRAWINGS

For a more complete understanding of the present invention, and the advantages thereof, reference is now made to the following descriptions taken in conjunction with the accompanying drawings, in which.

Corresponding numerals and symbols in the different figures generally refer to corresponding parts unless otherwise indicated. The figures are drawn to clearly illustrate the relevant aspects of the embodiments and are not necessarily drawn to scale.

DETAILED DESCRIPTION OF ILLUSTRATIVE EMBODIMENTS

The making and using of various embodiments are discussed in detail below. It should be appreciated, however, that the various embodiments described herein are applicable in a wide variety of specific contexts. The specific embodiments discussed are merely illustrative of specific ways to make and use various embodiments, and should not be construed in a limited scope.

Description is made with respect to various embodiments in a specific context, namely microphone transducers, and more particularly, MEMS microphones. Some of the various embodiments described herein include MEMS transducer systems, MEMS microphone systems, silicon microphones, and single and double backplate silicon microphones. In other embodiments, aspects may also be applied to other applications involving any type of microfabricated structure according to any fashion as known in the art.

According to various embodiments, a robust microfabricated structure is provided. The microfabricated structure includes a deflectable layer supported by a clamping layer. The deflectable layer has a first side and a second side. The clamping layer is arranged on the first side such that initial large deflections of the deflectable layer are in the direction of the first side. Such deflections cause the deflectable layer to bend around an edge of the clamping layer supporting the deflectable layer. In various embodiments, the edge of the clamping layer is a smooth edge with a variation of about 100 nm or less from a perfect line or smooth curve.

In various embodiments, the microfabricated structure includes a silicon microphone with a membrane clamped between a spacer clamping layer and a support clamping layer. The membrane is arranged such that sound pressure waves from a sound port are incident on a first side of the membrane opposite the support clamping layer. The membrane includes a deflectable portion that is unfixed and a fixed portion attached to the spacer clamping layer or the support clamping layer. The support clamping layer extends further towards the deflectable portion of the deflectable membrane than the spacer clamping layer such that large pressure waves incident on the deflectable membrane cause initial deflection around a smooth edge of the support clamping layer. In various embodiments, the smoothness of the support clamping layer is controlled by release etch holes formed in a layer adjacent the support clamping layer and opposite the membrane. In one specific embodiment, the release etch holes are formed in a backplate electrode over the membrane and the release etch holes are formed in a pattern defining the circumference of the deflectable portion of the deflectable membrane.

Figure 1:
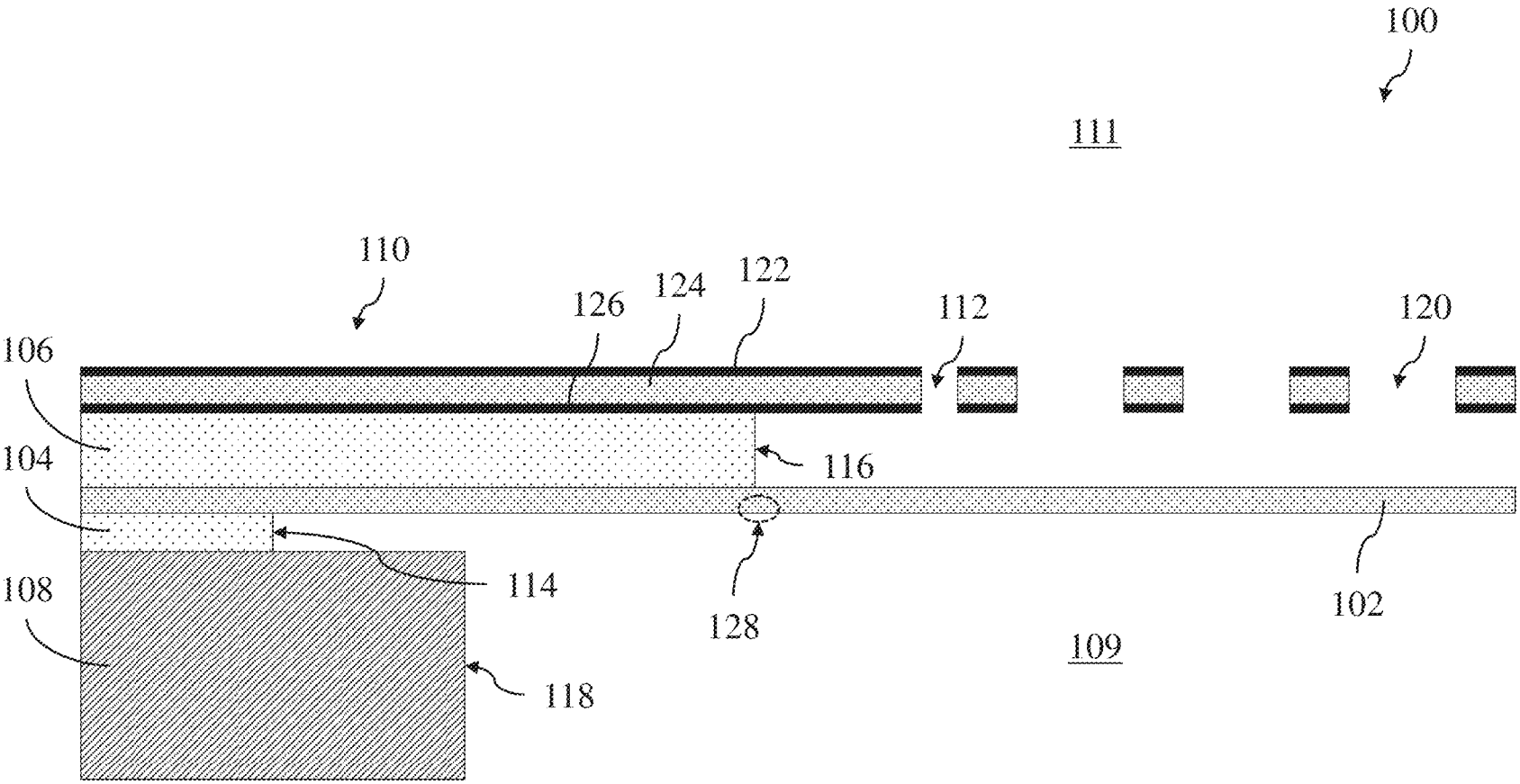
FIG. 1 illustrates a cross sectional view of an embodiment microfabricated device.

FIG. 1 illustrates a cross sectional view of a portion of an embodiment microfabricated device 100 including membrane 102, clamping layers 104 and 106, substrate 108, and backplate 110. According to various embodiments, microfabricated device 100 is a MEMS microphone. In such embodiments, membrane 102 is a deflectable sensing membrane that forms a parallel plate capacitor with backplate 110. Sound pressure waves are incident on membrane 102 from cavity 109, which is connected to a sound port (not shown) in the MEMS microphone. Sound pressure waves incident from cavity 109 may cause initial deflection of membrane 102 towards backplate 110, thereby decreasing the distance between backplate 110 and membrane 102 and increasing the capacitance. The change in capacitance may be sensed by readout electronics coupled to backplate 110 and membrane 102 through conductive lines (not shown). FIG. 1 illustrates only a portion of the microfabricated device 100, which may extend to a similar or identical clamping and support structure on an opposite side of the device. Microfabricated device 100 may have a circular and symmetric shape when viewed from above.

According to various embodiments, substrate 108 may be a silicon substrate or any other type of substrate and forms a support structure for the layers of microfabricated device 100. Cavity 109 is formed in substrate 108. In various embodiments, cavity 109 is formed using an etch, such as a Bosch process etch, that produces rough substrate edge 118 in substrate 108. For example, substrate edge 118 may have a variation of about 1 μm around a perfect line or smooth curve. In various embodiments, clamping layer 104 has rough edge 114 that may be approximately transferred from substrate edge 118 during another etch process. Clamping layer 104 may be formed as a tetraethyl orthosilicate (TEOS) oxide in some embodiments. Alternatively, clamping layer 104 may be formed of another insulating material, such as a dielectric or another oxide for example.

In various embodiments, membrane 102 is formed of doped polysilicon and supported by clamping layer 104. Membrane 102 may also be any other conductive material in other embodiments. Clamping layer 106 is formed as a TEOS oxide above membrane 102, effectively "clamping" the membrane as a support structure. In various embodiments, clamping layer 106 extends over cavity 109 and forms smooth edge 116 overlying cavity 109. Backplate no is formed on top of clamping layer 106 and includes insulating layer 126, conductive layer 124, and insulating layer 122. In one embodiment, insulating layers 122 and 126 are formed as silicon nitride layers and conductive layer 124 is formed as a doped polysilicon layer. In other embodiments, different materials or combinations may be used for any layers in microfabricated device 100. As stated for clamping layer 104, clamping layer 106 may be any type of insulating material. Further, backplate 110 may be formed of other insulating materials and conductive materials as is known in the art.

According to various embodiments, backplate 110 includes small diameter perforations 112 and large diameter perforations 120. Further, backplate 110 may include medium diameter perforations (not shown). Perforations 112 may serve as release holes for an etch step that etches clamping layer 106 and forms smooth edge 116. In various embodiments, perforations 112 may include numerous small diameter perforations arranged closely together around the perimeter of a deflectable portion of membrane 102. As is described further below in reference to FIGS. 3*a* and 3*b*, the spacing and size of perforations 112 are used to control the position and smoothness of edge 116. In some embodiments, smooth edge 116 may have a variation of about 100 nm around a perfect line or smooth curve.

According to various embodiments, when large sound pressure waves propagate into cavity 109 from a sound port (not shown), membrane 102 deflects towards backplate 110 and bends around clamping layer 106 at smooth edge 116. Region 128 includes a portion of membrane 102 where the stress is concentrated during deflection. In various embodiments, the type of bending and the edge affect the concentration of stress and are related to the robustness of microfabricated device 100, as is described below in reference to FIGS. 2*a* and 2*b*. The stress in region 128 may include primarily tensile stress. Alternatively, region 128 may include primarily compressive stress.

FIG. 1 illustrates microfabricated device 100 in which sound pressure waves are incident on membrane 102 from cavity 109. In alternative embodiments, microfabricated device 100 may include a top side sound port (not shown) coupled to cavity in above backplate 110. In such an embodiment, clamping layers 106 and 104 may be rearranged such that clamping layer 104 extends into cavity 109 beyond edge 118 and clamping layer 106 does not extend beyond edge 118. In such cases, clamping layer 104 may have a greater thickness than clamping layer 106.

Figure 2A:
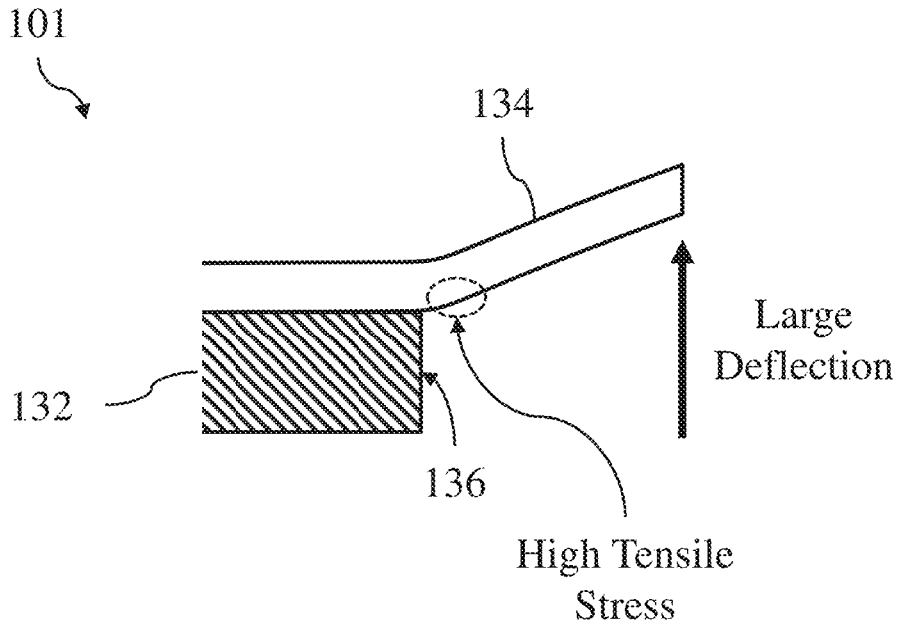
FIGS. 2*a* and 2*b* illustrate cross sectional views of an embodiment structure.
Figure 2B:
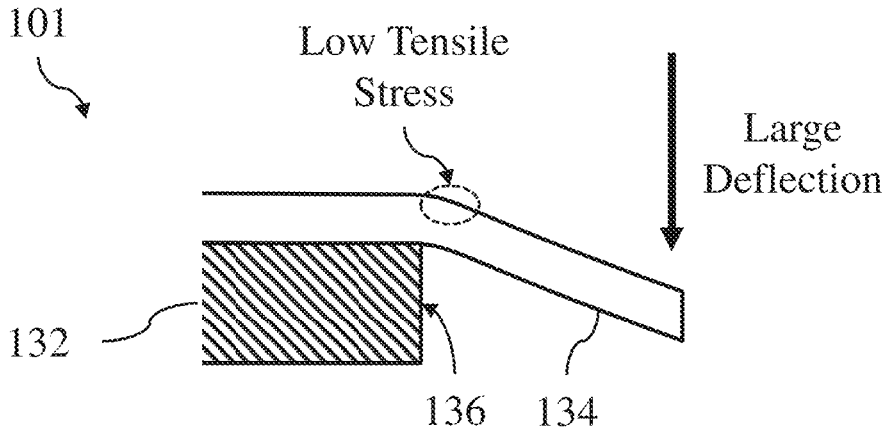

FIGS. 2*a* and 2*b* illustrate cross sectional views of an embodiment structure 101 including clamping layer 132 and deflectable layer 134. FIG. 2*a* illustrates deflectable layer 134 in deflection with bending away from clamping layer 132 and edge 136 while FIG. 2*b* illustrates deflectable layer 134 in deflection with bending towards clamping layer 132 and around edge 136. According to various embodiments, deflection away from an edge of a clamped interface, such as clamping layer 132 and the deflection in FIG. 2*a*, results in a high peak tensile stress at the bending point. Further, deflection around an edge of a clamped interface, such as clamping layer 132 and the deflection in FIG. 2*b*, results in a low peak tensile stress at the bending point.

According to various embodiments, large sound pressure waves incident on membrane 102 from cavity 109 in FIG. 1 produce a deflection of membrane 102 with bending around smooth edge 116 similar to the bending illustrated in FIG. 2*b*. Clamping layer 106 supports membrane 102 such that the tensile stress in region 128 is reduced compared to the type of deflection depicted in FIG. 2*a*. Because clamping layer 106 extends further into the space above cavity 109 than clamping layer 104, the initial bending of membrane 102 due to a large sound pressure wave is upward and away from cavity 109 and the stress is concentrated in region 128. Thus, the positioning of rough edge 114 and smooth edge 116 may affect the type of bending of membrane 102 and, in turn, the peak tensile stress in membrane 102, such as in region 128.

Figure 3A:
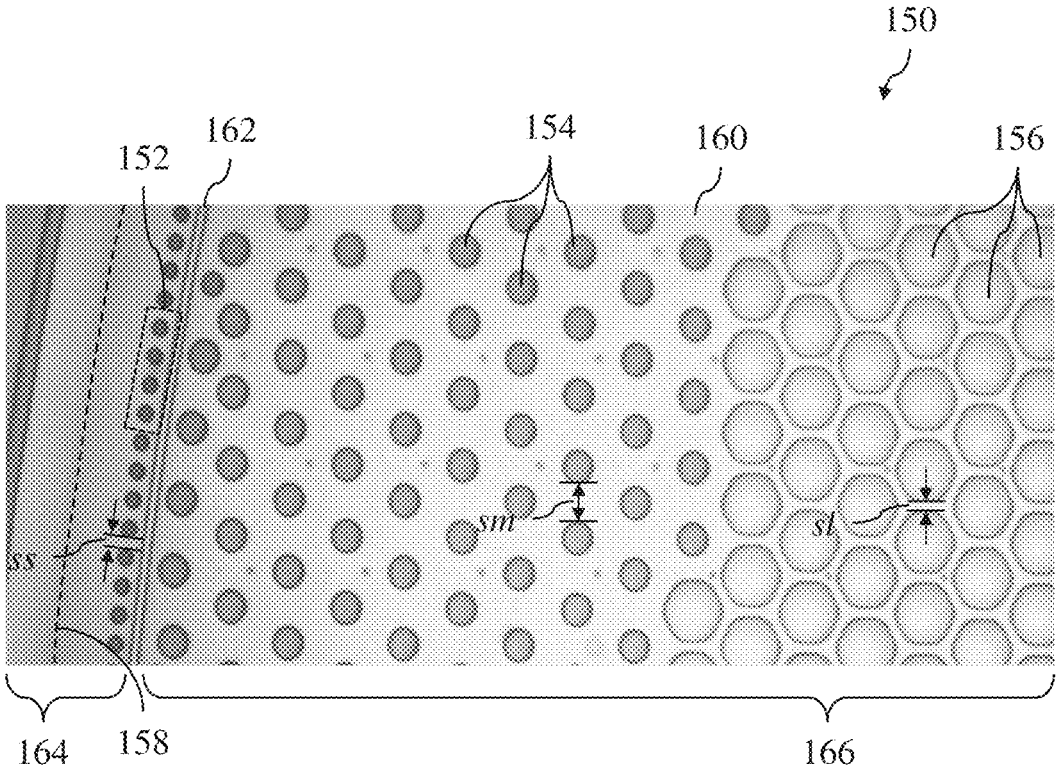
FIGS. 3*a* and 3*b* illustrate top views of an embodiment microfabricated device.
Figure 3B:
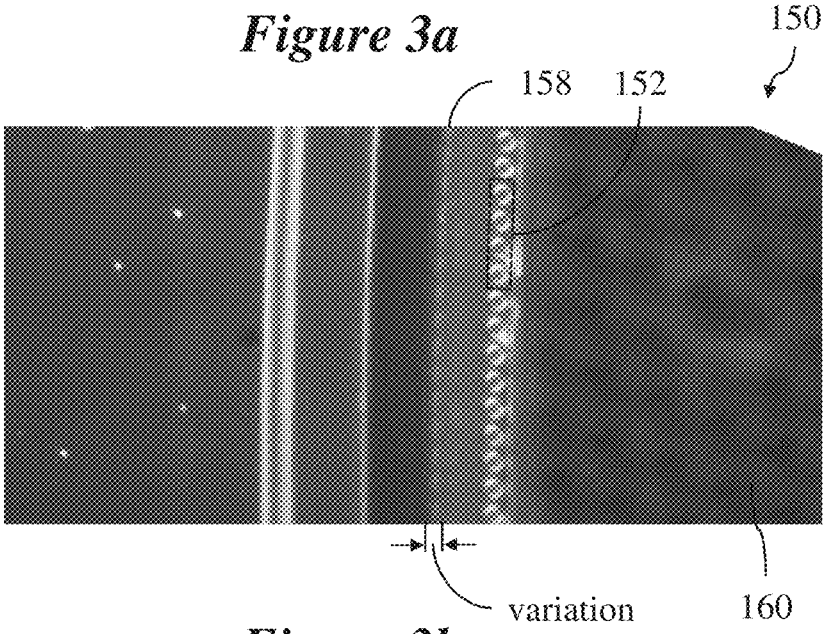

FIGS. 3*a* and 3*b* illustrate top views of a portion of embodiment microfabricated device 150 including backplate 160. According to various embodiments, microfabricated device 150, including backplate 160, may be an implementation of microfabricated device 100 and backplate 110. Backplate 160 may be a perforated backplate, as shown. In some embodiments, backplate 160 includes small diameter perforations 152, medium diameter perforations 154, and large diameter perforations 156. Each type of perforation may include a diameter d and a characteristic spacing distance s such that small diameter perforations 152 have a spacing ss between 1 and 2 μm and a diameter ds between 1 and 2 μm, medium diameter perforations 154 have a spacing sm between 3 and 7 μm and a diameter dm between 2 and 5 μm, and large diameter perforations 156 have a spacing sl between 1 and 2 μm and a diameter dl between 5 and 10 μm. In other embodiments, spacing and diameters outside of these ranges may be used. In particular embodiments, the spacing ss and sl for small and large diameter perforations 152 and 156 may be reduced below 1 μm, depending on fabrication techniques, materials, and fabrication reproducibility. Similarly, the diameter dl of large diameter perforations 156 may be greater than 10 μm, depending on fabrication techniques, materials, and fabrication reproducibility.

According to various embodiments, clamping edge 158 of a structural layer beneath backplate 160 has a roughness determined by spacing ss and diameter ds of small diameter perforations 152. In such embodiments, small diameter perforations 152 are release holes used for etching the structural layer beneath backplate 160, such as clamping layer 106 in FIG. 1, for example. The etching may be performed as an isotropic wet etch that exhibits an over-etch in the structural layer beneath backplate 160 surrounding each perforation. In other embodiments, other etches may be performed, such as a dry etch, for example. The spacing ss, the diameter ds of small diameter perforations 152, and the over-etch may influence how far and how smoothly clamping edge 158 is etched. In some embodiments, a larger over-etch produces a smoother clamping edge 158. Further, spacing sm and diameter dm for medium diameter perforations 154 and spacing sl and diameter dm for large diameter perforations 156 may affect sensitivity and robustness of microfabricated device 150. Thus, in some embodiments, spacing sl is less than spacing sm while diameter dl is greater than diameter dm in order to increase the robustness and sensitivity of microfabricated device 150.

According to some embodiments, segmentation 162 is formed between peripheral backplate area 164 and central backplate area 166. Central backplate area 166 may include the active sensing portion of backplate 160 and peripheral backplate area 164 may include the inactive non-sensing portion of backplate 160. In such embodiments, segmentation 162 is a non-conductive region between peripheral backplate area 164 and central backplate area 166. Segmentation 162 may be either inside or outside the ring of small diameter perforations 152 in various embodiments.

FIG. 3*b* illustrates a further magnified top view of embodiment microfabricated device 150 showing clamping 158. As described briefly above, the smoothness of clamping edge 158, which is the edge of the structural material beneath backplate 160, may be determined by small diameter perforations 152. Each of the small diameter perforations 152 allows a small amount of etchant to pass through to etch the structural layer (not shown) beneath backplate 160 at a predictable rate and to undercut backplate 160. For a single round perforation, the etching pattern is a circle undercut around the round perforation. According to various embodiments, small diameter perforations 152 are arranged in close proximity to produce clamping edge 158 as a summation of overlapping etched shapes, such as circles, for example. Based on such small and closely spaced perforations, clamping edge 158 is formed with a maximum variation from a smooth curve or straight line of about 100 nm, as discussed above in reference to FIG. 1. In alternative embodiments, the variation of clamping edge 158 is greater than 100 nm.

Figure 4A:
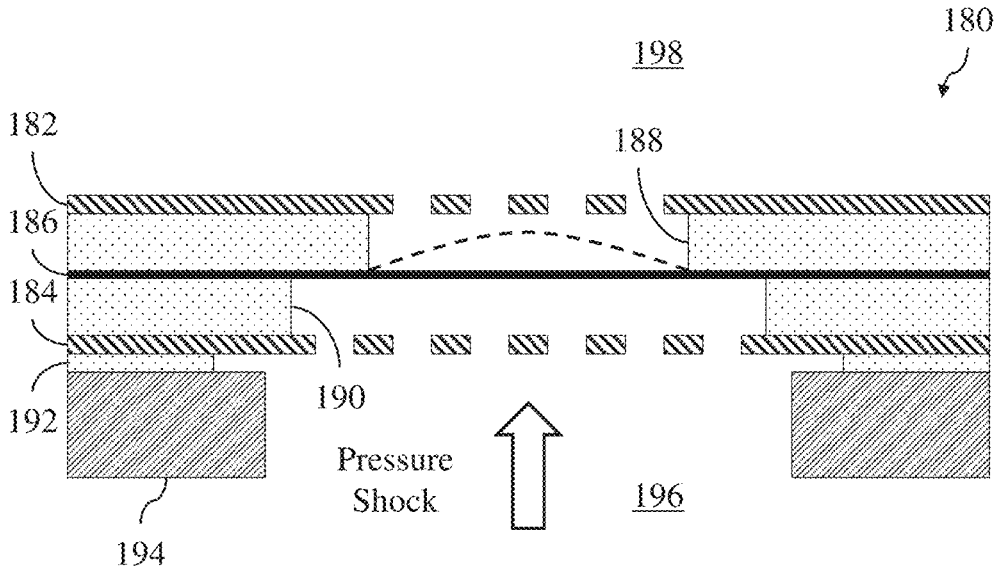
FIGS. 4*a* and 4*b* illustrate cross sectional views of additional embodiment microfabricated devices.
Figure 4B:
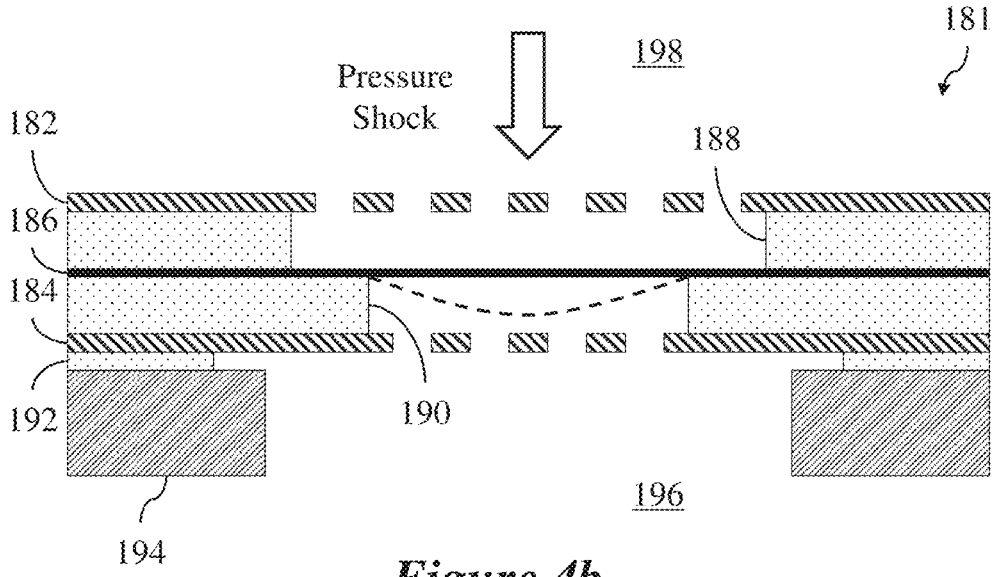

FIGS. 4*a* and 4*b* illustrate cross sectional views of additional embodiment dual backplate microphones 180 and 181. According to various embodiments, dual backplate microphones 180 and 181 each include top backplate 182 and bottom backplate 184 with deflectable membrane 186 placed between top and bottom backplates 182 and 184. Clamping layers 188, 190, and 192 are placed between top backplate 182, membrane 186, bottom backplate 184, and substrate 194. Deflectable membrane 186 separates cavity 196 from cavity 198.

According to various embodiments, dual backplate microphone 180 includes a sound port (not shown) coupled to cavity 196 while dual backplate microphone 181 includes a sound port (not shown) coupled to cavity 198. Thus, dual backplate microphone 180 receives large sound pressure waves or shocks from below while dual backplate microphone 181 receives large sound pressure waves or shocks from above. In such embodiments, the structures of dual backplate microphones 180 and 181 may differ slightly such that the clamping layer opposite the cavity coupled to the sound port extends further than the clamping layer on the same side as the cavity coupled to the sound port. Thus, clamping layer 188 extends further over cavity 196 than clamping layer 190 for dual backplate microphone 180 in FIG. 4*a* while clamping layer 190 extends further over cavity 196 than clamping layer 188 for dual backplate microphone 181 in FIG. 4*b*.

According to various embodiments, large sound pressure waves incident on membrane 186 cause deflection with bending around edges of clamping layer 188 for dual backplate microphone 180 and large sound pressure waves incident on membrane 186 cause deflection with bending around edges of clamping layer 190 for dual backplate microphone 181. In various embodiments, the extension of clamping layers 188 and 190 over cavity 196 may be determined by the size and position of perforations in backplates 182 and 184, respectively, as described above in reference to single backplate 110 and clamping layer 106 in FIG. 1.

Figure 5A:
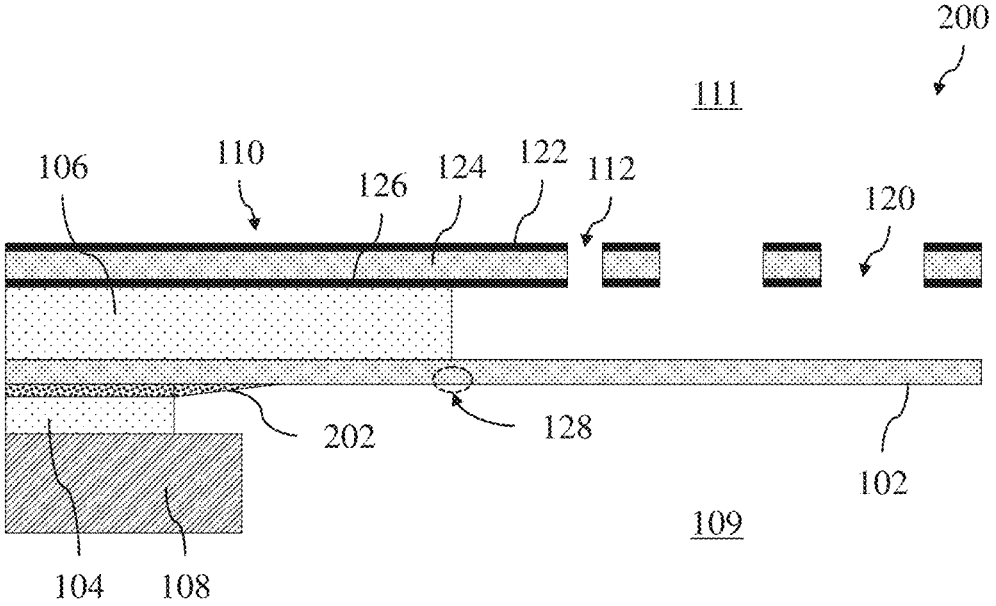
FIGS. 5*a* and 5*b* illustrate cross sectional views of further embodiment microfabricated devices.
Figure 5B:
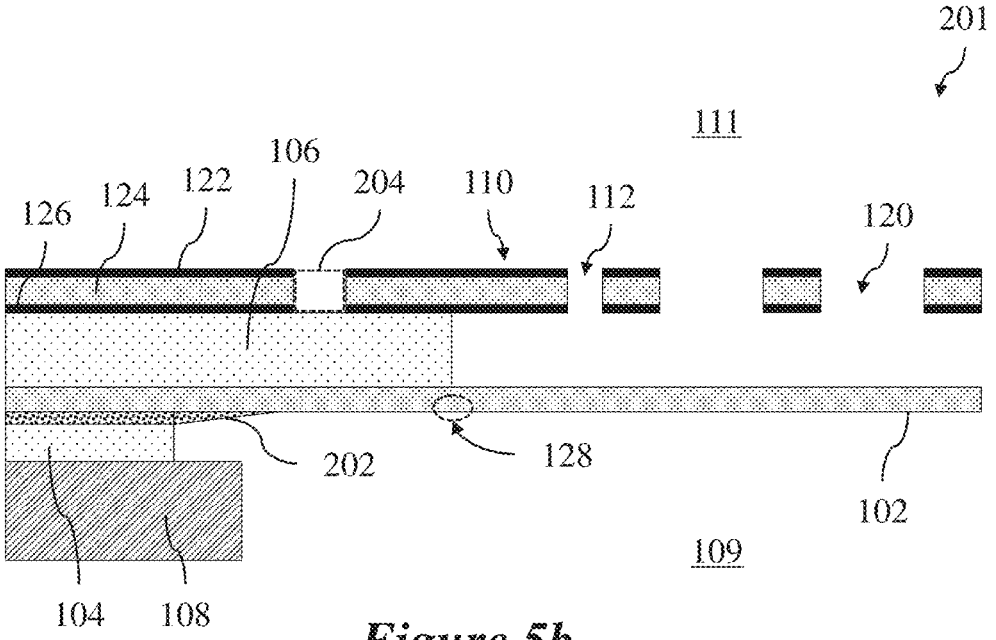

FIGS. 5*a* and 5*b* illustrate cross sectional views of further embodiment microfabricated devices 200 and 201, each including membrane 102, clamping layers 104 and 106, substrate 108, and backplate 110. According to various embodiments, microfabricated device 200 further includes taper layer 202 formed between membrane 102 and clamping layer 104. In some embodiments, taper layer 202 reduces the peak stress in membrane 102 during bending deflection. Taper layer 202 may be formed of silicon dioxide, silicon nitride, silicon oxynitride, or another material, for example. Further description, including various modifications, for taper layer 202 are described in U.S. Pat. No. 8,461,655 entitled "Micromechanical sound transducer having a membrane support with tapered surface," which is incorporated herein by reference in its entirety. The other elements or layers of microfabricated device 200 correspond to the description above in reference to FIG. 1 and are not repeated here.

According to various embodiments, microfabricated device 201 includes taper layer 202 and further includes segmentation 204 in backplate 110. Segmentation 204 may be a non-conductive material or structure formed in backplate 110 that separates an active sensing portion of backplate 110 from a passive or non-sensing portion of backplate 110. The active sensing portion of backplate 110 includes the portion of backplate 110 released from clamping layer 106, primarily overlying cavity 109, or including backplate perforations 120. The passive portion of backplate 110 includes the portion overlying substrate 108 and clamping layer 106 and not released from clamping layer 106. In some embodiments, segmentation 204 disconnects a parasitic capacitance that is formed between the passive portion of backplate 110 and membrane 102 or substrate 108 from the active sensing portion of backplate 110. Disconnecting the parasitic capacitance may improve the sensitivity of microfabricated device 201. Segmentation 204 may be formed as a nitride layer, or another type of non-conductive material. In an alternative embodiment, segmentation 204 includes a gap in backplate 110 where conductive layer 124 is removed from backplate 110. Further description, including various modifications, for segmentation 204 are described in U.S. patent application Ser. No. 14/275,337 entitled "MEMS Device," which is incorporated herein by reference in its entirety. The other elements or layers of microfabricated device 201 correspond to the description above in reference to FIG. 1 and are not repeated here.

Figure 6:
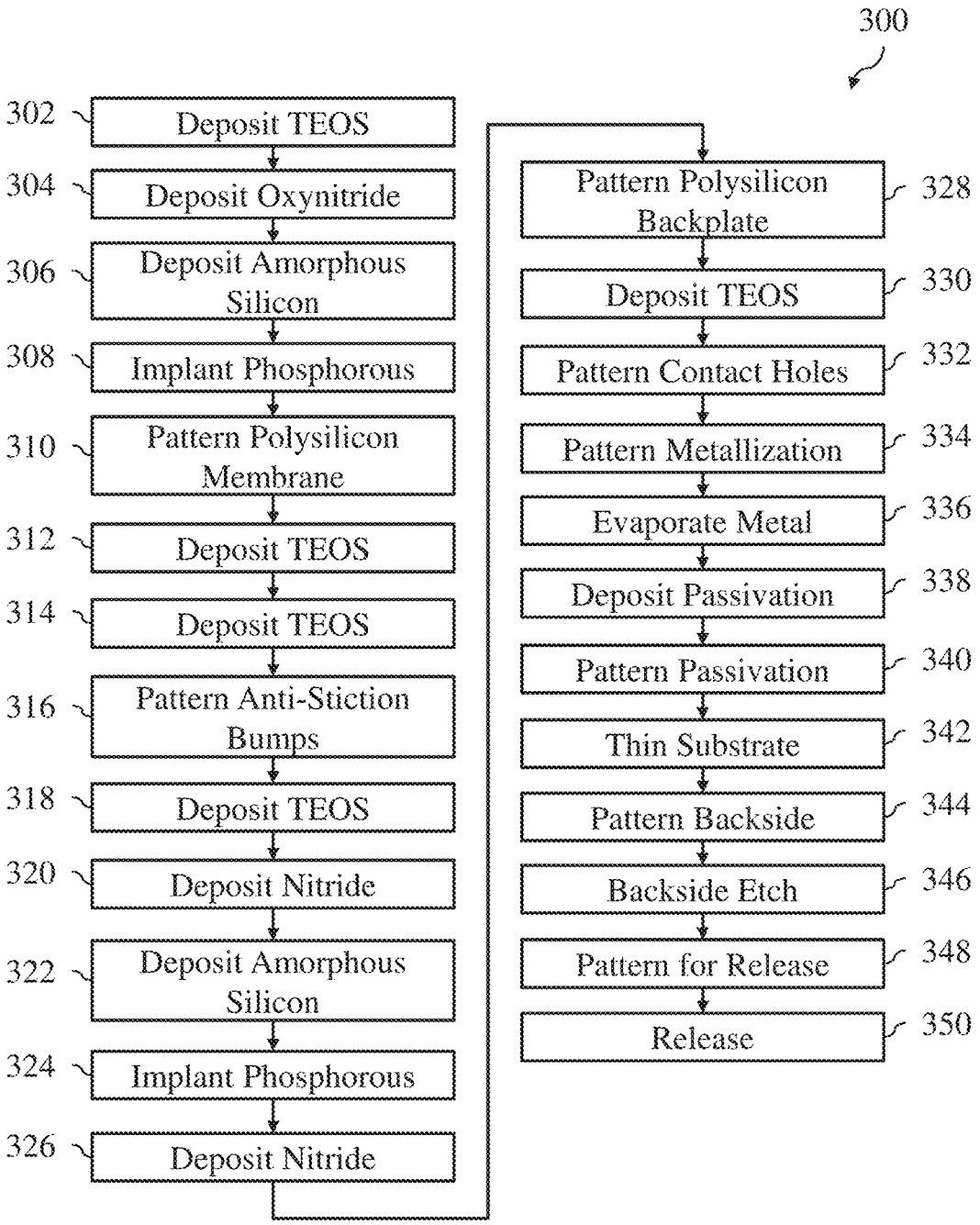
FIG. 6 illustrates a block diagram of an embodiment fabrication sequence.

FIG. 6 illustrates a block diagram of an embodiment fabrication sequence 300 including steps 302-350. According to various embodiments, fabrication sequence 300 is a fabrication sequence for producing various embodiment microfabricated devices, such as microfabricated device 100 as shown in FIG. 1, for example. Fabrication sequence 300 may also be applied and/or modified in order to produce various other embodiments described herein as well as equivalents.

According to various embodiments, step 302 includes depositing TEOS on a substrate and forming a TEOS oxide layer. The substrate may be a silicon substrate or any other substrate material, such as another semiconductor material or plastic, for example. The TEOS oxide layer may have a thickness between 500 and 700 nm. Step 304 includes depositing an oxynitride on the TEOS oxide layer. The oxynitride layer may have a thickness between 100 and 200 nm. In various other embodiments, depositing the oxynitride layer in step 304 may be omitted. Step 306 includes depositing amorphous silicon on the oxynitride layer. The silicon layer may have a thickness between 100 and 1000 nm. In more particular embodiments, the silicon layer may have a thickness between 250 and 400 nm or between 600 and 800 nm. In step 308, the silicon layer is doped with phosphorous ion implantation. In other embodiments, other dopants may be used. Through the doping process, the amorphous silicon layer may be formed into doped polysilicon. The doping process may also involve heating the workpiece in an oven. As described herein, workpiece refers to the structure passing through the fabrication sequence beginning with the substrate and including each layer formed thereon.

In various embodiments, step 310 includes patterning the polysilicon layer to form a membrane, such as membrane 102 in FIG. 1. Patterning the polysilicon layer in step 310, as well as patterning in other steps, may include depositing a photoresist layer, exposing the photoresist layer according to a mask pattern corresponding to the membrane structure, developing the photoresist to remove the non-pattern portions according to the exposure, etching the polysilicon layer, or other layers, according to the patterned photoresist, and removing the photoresist after completing the etch. Following the patterning of the polysilicon layer into a membrane, step 312 includes depositing a TEOS layer and forming another TEOS oxide layer. The TEOS oxide layer formed in step 312 may have a thickness between 700 and 800 nm. Step 314 includes depositing another TEOS layer and forming further TEOS oxide layer on the TEOS oxide formed in step 312. The TEOS oxide layer formed in step 314 may have a thickness between 400 and 600 nm.

In various embodiments, step 316 includes patterning the TEOS oxide layer for anti-stiction bumps. The TEOS oxide may be patterned according to photolithographic steps to include depressions that are transferred to a backplate layer formed over the TEOS oxide layer in the subsequent steps. Another TEOS layer is deposited for forming an additional TEOS oxide layer in step 318. The TEOS oxide formed in step 318 may have a thickness between 600 and 700 nm. Step 320 includes depositing a nitride layer with a thickness between 100 and 200 nm. Step 322 includes depositing a layer of amorphous silicon with a thickness between 200 and 400 nm. The silicon may be doped in step 324 with a phosphorous ion implant that may also form doped polysilicon out of the amorphous silicon deposited in step 322. Other dopants may be used in place of phosphorous in other embodiments. Step 326 includes depositing another layer of nitride with a thickness between 100 and 200 nm.

In various embodiments, step 328 includes patterning the polysilicon layer to form a backplate, such as backplate 110 in FIG. 1. The backplate may be formed with anti-stiction bumps and perforations. In some embodiments, the perforations may include both large and small diameter perforations as described hereinabove in reference to FIGS. 1, 3*a*, and 3*b*. Further, the perforations may also include medium diameter perforations as described hereinabove. Step 330 includes depositing a further TEOS layer for forming a further TEOS oxide layer with a thickness between 700 and 800 nm.

In various embodiments, step 332 includes patterning contact holes for providing conductive contacts to electrically active layers, such as the membrane, backplate, and substrate, for example. Following the patterning of contact holes in step 332, the patterning of metallization may be performed in step 334. Patterning the metallization may include applying a layer of photoresist and patterning the photoresist in an inverse manner to the desired metallization. In step 336, the metallization may be applied onto the patterned photoresist through a metal evaporation process. The desired metallization may be formed in the contact holes and as metal traces from the contact holes to contact pads, for example. The evaporated metallization that is undesired may be removed with the inversely patterned photoresist in a lift-off process. In various embodiments, the metallization may also be deposited through other processes, such as sputtering, for example. The metallization may include any conductive material, such as titanium, platinum, gold, or aluminum for example, and may have a thickness between 300 and 500 nm. In alternative embodiments, the metallization may include conductive mixtures or copper, for example. In some embodiments, some types of metallization or conductive mixtures are formed without a lift-off process and steps 334 and 336, or equivalents, are reversed. For example, embodiments using aluminum for the metallization may replace steps 334 and 336 with the sequence of: (1) depositing an aluminum layer, such as through sputtering, (2) applying and lithographically patterning photoresist, and (3) etching the aluminum layer according to the patterned photoresist. In other embodiments using copper for the metallization may involve replacing steps 334 and 336 with a damascene process for forming patterned copper and a barrier material.

In various embodiments, step 338 includes depositing a passivation layer on the workpiece with a thickness between 300 and 500 nm. The passivation layer may be silicon nitride or another nonreactive insulator, for example. Step 340 includes patterning the passivation layer. For example, step 340 may include removing the passivation from contact pads formed in steps 334 and 336. Step 342 may include thinning the substrate. In some embodiments, this may involve a mechanical grinding away of the substrate. The thinned substrate may have a thickness between 350 and 500 μm.

In various embodiments, step 344 includes patterning the backside of the substrate. In this case, step 344 may include depositing photoresist on the backside of the substrate, exposing the photoresist, and removing the unwanted photoresist in preparation for an etch of a substrate cavity. Step 346 may include performing the backside etch to produce the cavity in the substrate below the membrane and backplate. In some embodiments, the etch is a plasma etch that may be performed according to the Bosch process. Step 348 may include patterning the workpiece for release. Patterning the workpiece may include applying photoresist on the topside of the wafer, exposing the photoresist, and developing the exposed photoresist. The patterned photoresist may be produced such that the area above and below the backplate and membrane layers is clear of photoresist. Step 350 may include the release etch. During the release etch, the insulating layers above, and below the membrane and backplate may be removed. The insulating layers may include oxide layers above, below, and between the backplate and membrane. In one example embodiment, the insulating layers etched during step 350 may include clamping layer 104 and clamping layer 106 in FIG. 1, as well as an additional insulating layer formed on backplate 110 that is not shown in FIG. 1.

According to various embodiments, the steps and materials deposited, formed, or patterned in steps 302-350 may be readily substituted for other steps and materials as is known in the art. For example, any oxide, nitride, or oxynitride may be substituted for other insulating materials and dielectrics in alternative embodiments. Further, the amorphous silicon and polysilicon materials may also be substituted with any other doped or undoped semiconductor materials, metals, or metal silicides, for example, in other embodiments. In addition, the patterning steps described herein may include photolithography or other non-lithographic methods in various embodiments. The growing, forming, or depositing of materials may be modified according to the specific materials to be used. In other embodiments, the layers may be formed with thicknesses outside the ranges specified in steps 302-350.

Figure 7A:
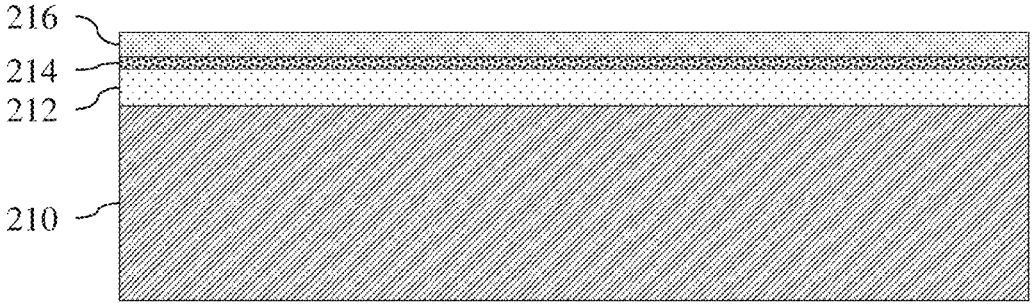
FIGS. 7*a*, 7*b*, 7*c*, 7*d*, and 7*e* illustrate cross sectional views of an embodiment microfabricated device at different stages in an embodiment fabrication sequence.

FIGS. 7*a*, 7*b*, 7*c*, 7*d*, and 7*e* illustrate cross sectional views of an embodiment microfabricated device at different stages in an embodiment fabrication sequence. The fabrication sequence described in reference to FIG. 6 corresponds to the cross sectional views illustrated in FIGS. 7*a*-7*e*. FIG. 7*a* illustrates an embodiment workpiece corresponding to steps 302-310 in FIG. 6 and including substrate 210, TEOS oxide layer 212, oxynitride layer 214, and membrane layer 216. According to various embodiments, as described above, membrane layer 216 is formed in steps 306 and 308 from amorphous silicon that is processed to form doped polysilicon. Membrane layer 216 may be patterned in step 310 such that the polysilicon layer only remains in the areas defined for the membrane and does not cover the entire workpiece. In some embodiments, oxynitride layer 214 may be omitted.

Figure 7B:
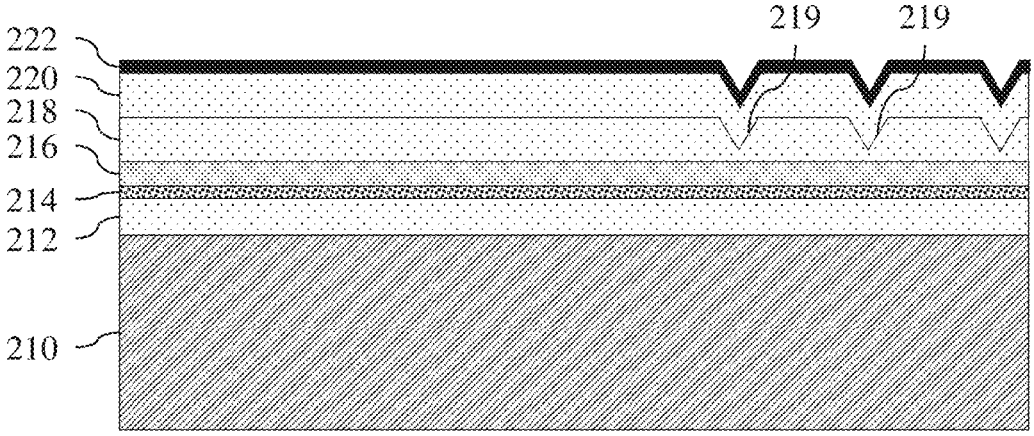

FIG. 7*b* illustrates an embodiment workpiece corresponding to steps 312-320 in FIG. 6 and further including TEOS oxide layers 218 and 220 as well as nitride layer 222. According to various embodiments, TEOS oxide layer 218 is patterned with anti-stiction bump patterns 219. When TEOS oxide layer 220 and nitride layer 222 are deposited, the layers form similar bumps by following the pattern formed by anti-stiction bump patterns 219.

Figure 7C:
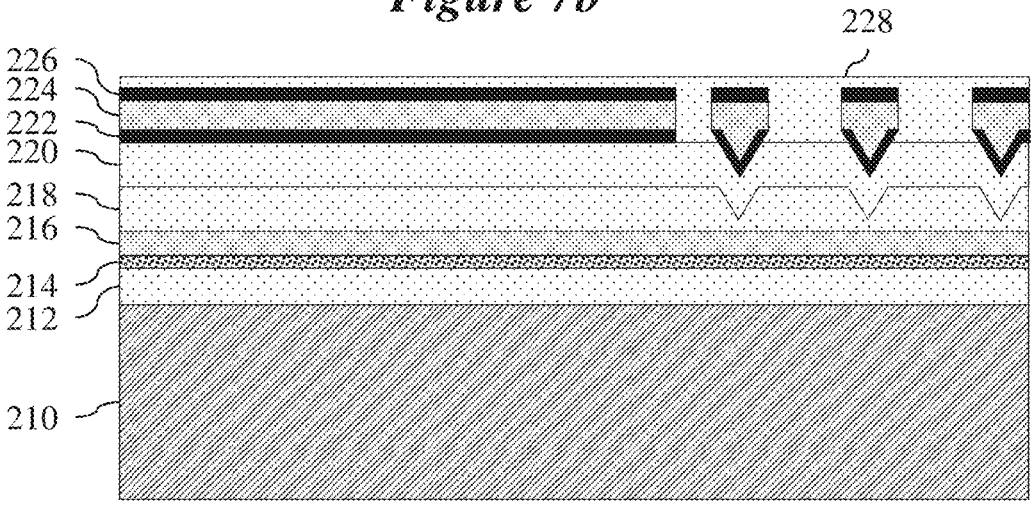

FIG. 7*c* illustrates an embodiment workpiece corresponding to steps 322-330 in FIG. 6 and further including polysilicon layer 224, nitride 226, and TEOS oxide layer 228. According to various embodiments, polysilicon layer 224 is formed in a similar process as membrane layer 216, including amorphous silicon deposition and processing to form doped polysilicon. Together, nitride layer 222, polysilicon layer 224, and nitride layer 226 may form a backplate, such as backplate 110 in FIG. 1. As described above, step 328 in FIG. 6 includes patterning nitride layer 222, polysilicon layer 224, and nitride layer 226 to form openings or perforations. TEOS oxide layer 228 may be formed over the backplate.

Figure 7D:
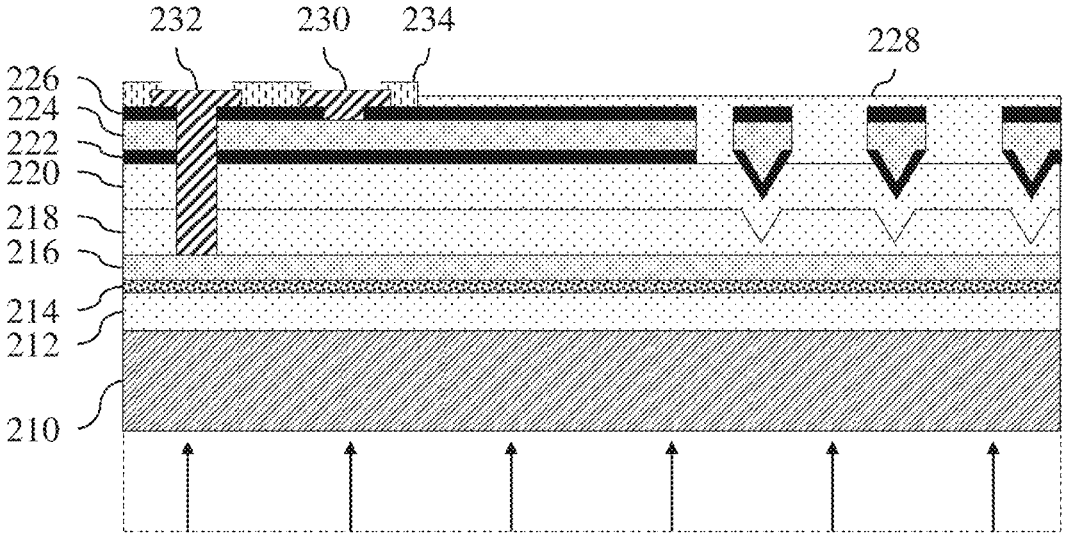

FIG. 7*d* illustrates an embodiment workpiece corresponding to steps 332-342 in FIG. 6 and further including metal contact 230 and 232 as well as passivation layer 234. According to various embodiments, the contact holes for metal contacts 230 and 232 are formed in patterning step 332, a photoresist is patterned with an inverse of the desired pattern in step 334, the metal for metal contacts 230 and 232 is deposited in step 336, and a lift-off step is used to remove the extra metallization. Passivation layer 234 is deposited and patterned in steps 338 and 340. FIG. 7*d* also illustrates that substrate 210 is thinned in step 342.

Figure 7E:
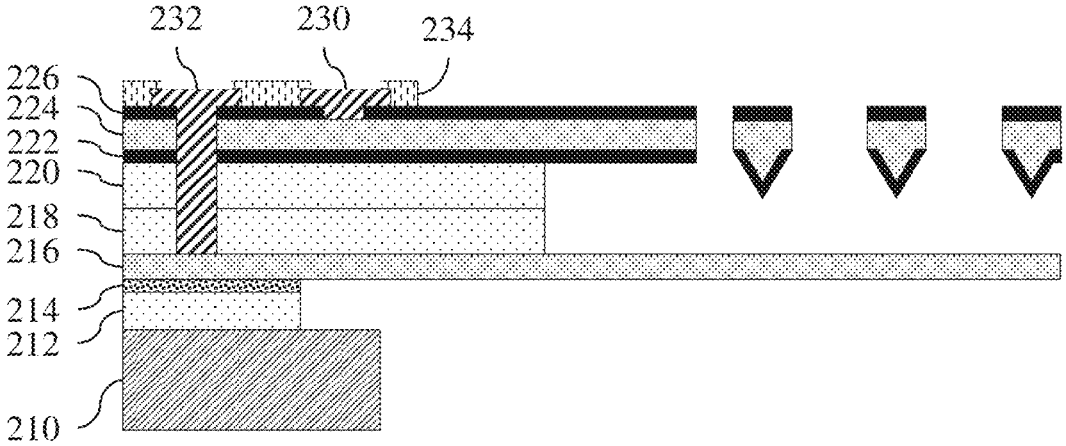

FIG. 7*e* illustrates an embodiment workpiece corresponding to steps 344-350 in FIG. 6 and includes substrate 210 after patterning and a backside etch in steps 344 and 346, as well as a released membrane and backplate after TEOS oxide layers 212, 218, 220, and 228 and oxynitride layer 214 undergo the release etch in step 350. In various embodiments, the various steps and layers illustrated in FIGS. 7*a*-7*e* may be modified as described above in reference to FIG. 6.

According to an embodiment, a microfabricated structure includes a cavity disposed in a substrate, a first clamping layer overlying the substrate, a deflectable membrane overlying the first clamping layer, and a second clamping layer overlying the deflectable membrane. In such cases, a portion of the second clamping layer overlaps the cavity.

In various embodiments, the microfabricated structure also includes a sensing layer overlying the second clamping layer. The sensing layer includes a plurality of evenly spaced release holes. The sensing layer may also include perforations throughout an area overlying the cavity. A roughness of a cavity sidewall of the first clamping layer may be greater than a roughness of a cavity sidewall of the second clamping layer. The cavity sidewall of the first clamping layer has a surface variation of about 1 μm and the cavity sidewall of the second clamping layer has a surface variation of about 100 nm.

In various embodiments, a cavity sidewall of the first clamping layer overlaps the substrate and does not overlap the cavity. The microfabricated structure may also include a tapered clamping layer formed between a top surface of the first clamping layer and a bottom surface of the deflectable membrane. The tapered clamping layer includes a sloping edge formed at a vertical edge of the first clamping layer and extending along the deflectable membrane toward a region overlying the cavity. The second clamping layer may be in contact with the deflectable membrane.

According to an embodiment, a microfabricated device includes a first backplate, a first clamping layer disposed adjacent to the first backplate, a second backplate, a second clamping layer disposed adjacent to the second backplate, and a membrane layer disposed between the first clamping layer and the second clamping layer. The first backplate includes a first region with perimeter perforations surrounding a first area. The first clamping layer includes a first cavity with a second area larger than the first area. The second backplate includes a second region with perimeter perforations surrounding a third area that is larger than the first area. The second clamping layer includes a second cavity with a fourth area larger than the second area.

In various embodiments, the second cavity is acoustically coupled to a sound port. The microfabricated device may include a substrate including a third cavity. In some embodiments, the third cavity is separated from the first cavity by the first backplate. In other embodiments, the third cavity is separated from the second cavity by the second backplate. The first backplate and the second backplate may each include central perforations surrounded by the perimeter perforations. The central perforations have a larger diameter than the perimeter perforations. The first backplate and the second backplate may also each include intermediate perforations. The intermediate perforations have a larger diameter than the perimeter perforations and a smaller diameter than the central perforations. In some embodiments, the perimeter perforations have a diameter less than or equal to 1.5 μm. The perimeter perforations surrounding the first area may completely surround the first area and the perimeter perforations surrounding a third area may completely surround the third area.

According to an embodiment, a method of fabricating a device includes forming a cavity in a substrate, forming a first clamping layer over the substrate, forming a deflectable membrane over the first clamping layer, and forming a second clamping layer over the deflectable membrane. In such embodiments, a portion of the second clamping layer overlaps with the cavity.

In various embodiments, forming a cavity in a substrate includes etching through the substrate from a backside of the substrate to a front-side of the substrate. Forming a first clamping layer may include depositing an insulating layer on the substrate and etching the insulating layer in and around the cavity. Forming a deflectable membrane over the first clamping layer may include depositing a conductive material over the substrate and patterning the conductive material to form the deflectable membrane.

In various embodiments, the method of fabricating a device also includes forming a backplate over the second clamping layer. The backplate may include perimeter perforations surrounding a sensing area of the backplate. Forming a second clamping layer over the deflectable membrane may include depositing an insulating layer on the deflectable membrane and etching the insulating layer in and around the perimeter perforations.

Advantages of various embodiments described herein may include microfabricated devices exhibiting improved robustness for shock and loud sound pressure waves. Embodiment microfabricated devices may include clamping layers for membrane or backplate with increased sidewall smoothness having variation of less than about 100 nm.

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description. It is therefore intended that the appended claims encompass any such modifications or embodiments.

What is claimed is:

1. A method of fabricating a microfabricated device, the method comprising:

forming a first cavity in a substrate, the first cavity having a first planar area extending across the substrate and being enclosed by a sidewall of the substrate that faces the first cavity;

forming a first clamping layer over the substrate comprising a second cavity having a second planar area extending across the first clamping layer and being enclosed by a sidewall of the first clamping layer that faces the second cavity;

forming a deflectable membrane over the first clamping layer, wherein a top surface of the first clamping layer is in contact with a bottom surface of the deflectable membrane; and forming a second clamping layer over the deflectable membrane comprising a third cavity having a third planar area extending across the second clamping layer and being enclosed by a sidewall of the second clamping layer that faces the third cavity;

forming a first backplate between the substrate and the first clamping layer comprising outermost perimeter perforations surrounding a fourth planar area; and forming a second backplate over the second clamping layer comprising outermost perimeter perforations surrounding a fifth planar area, wherein the first planar area is larger than the second planar area, the second planar area is larger than the third planar area, wherein the fourth planar area is larger than the fifth planar area, wherein the second planar area is larger than the fourth planar area, and wherein the third planar area is larger than the fifth planar area.

2. The method of claim 1, wherein forming a cavity in a substrate comprises etching through the substrate from a backside of the substrate to a front-side of the substrate.

3. The method of claim 1, wherein forming a first clamping layer comprises:

depositing an insulating layer on the substrate; and etching the insulating layer in and around the second cavity.

4. The method of claim 1, wherein forming a deflectable membrane over the first clamping layer comprises:

depositing a conductive material over the substrate; and patterning the conductive material to form the deflectable membrane.

5. The method of claim 1, wherein forming a second clamping layer over the deflectable membrane comprises:

depositing an insulating layer on the deflectable membrane; and etching the insulating layer in and around the third cavity.

6. The method of claim 1, wherein forming the second backplate comprises forming a second backplate with differently sized perforations.

7. The method of claim 1, wherein forming the second backplate comprises forming a second backplate with differently sized perforation spacings.

8. A method of fabricating a microfabricated device, the method comprising:

forming a first backplate comprising a first region with outermost perimeter perforations surrounding a first planar area;

forming a first clamping layer adjacent to the first backplate, the first clamping layer comprising a first cavity with a second planar area larger than the first planar area, the second planar area extending across the first cavity and being enclosed by a sidewall of the first clamping layer that faces the first cavity;

forming a second backplate comprising a second region with outermost perimeter perforations surrounding a third planar area that is larger than the first planar area;

forming a second clamping layer adjacent to the second backplate, the second clamping layer comprising a second cavity with a fourth planar area larger than the second planar area, the fourth planar area extending across the second cavity and being enclosed by a sidewall of the second clamping layer that faces the second cavity;

forming a membrane layer between the first clamping layer and the second clamping layer; and forming a substrate comprising a third cavity, wherein the third cavity has a fifth planar area larger than the fourth planar area, the fifth planar area extending across the third cavity and being enclosed by a sidewall of the substrate that faces the third cavity.

9. The method of claim 8, wherein forming the third cavity comprises etching through the substrate from a backside of the substrate to a front-side of the substrate.

10. The method of claim 8, wherein forming the first clamping layer comprises:

depositing an insulating layer on the substrate; and etching the insulating layer in and around the perimeter perforations in the first region.

11. The method of claim 8, wherein forming the substrate comprises separating the third cavity from the first cavity by the first backplate.

12. The method of claim 8, wherein forming the substrate comprises separating the third cavity is separated from the second cavity by the second backplate.

13. The method of claim 8, wherein the second cavity is acoustically coupled to a sound port.

14. The method of claim 8, wherein forming the first backplate comprises forming central perforations surrounded by the outermost perimeter perforations, and wherein the central perforations have a larger diameter than the outermost perimeter perforations.

15. The method of claim 14, wherein forming the first backplate further comprises forming intermediate perforations, and wherein the intermediate perforations surround the central perforations and are surrounded by the outermost perimeter perforations, and the intermediate perforations have a larger diameter than the outermost perimeter perforations and a smaller diameter than the central perforations.

16. The method of claim 14, wherein the outermost perimeter perforations have a diameter less than or equal to 1.5 μm.

17. The method of claim 8, wherein forming the second backplate comprises forming central perforations surrounded by the outermost perimeter perforations, and wherein the central perforations have a larger diameter than the outermost perimeter perforations.

18. The method of claim 17, wherein forming the second backplate further comprises forming intermediate perforations, and wherein the intermediate perforations surround the central perforations and are surrounded by the outermost perimeter perforations, and the intermediate perforations have a larger diameter than the outermost perimeter perforations and a smaller diameter than the central perforations.

19. The method of claim 8, wherein the outermost perimeter perforations surrounding the first planar area completely surround the first planar area and are evenly spaced, and the outermost perimeter perforations surrounding a third planar area completely surround the third planar area and are evenly spaced.

20. A method of fabricating a microfabricated device, the method comprising:

forming a first cavity in a substrate, the first cavity having a first planar area extending across the substrate and being enclosed by a sidewall of the substrate that faces the first cavity;

forming a first clamping layer over the substrate comprising a second cavity having a second planar area extending across the first clamping layer and being enclosed by a sidewall of the first clamping layer that faces the second cavity;

forming a deflectable membrane over the first clamping layer, wherein a top surface of the first clamping layer is in contact with a bottom surface of the deflectable membrane; and forming a second clamping layer over the deflectable membrane comprising a third cavity having a third planar area extending across the second clamping layer and being enclosed by a sidewall of the second clamping layer that faces the third cavity;

forming a first backplate between the substrate and the first clamping layer comprising outermost perimeter perforations surrounding a fourth planar area; and forming a second backplate over the second clamping layer comprising outermost perimeter perforations surrounding a fifth planar area, wherein the first planar area is larger than the third planar area, the third planar area is larger than the second planar area, and the fifth planar area is larger than the fourth planar area, wherein the second planar area is larger than the fourth planar area, and wherein the third planar area is larger than the fifth planar area.

* * * * *